United States Patent [19]

Rech

[11] 4,141,476

[45] Feb. 27, 1979

[54] VALVED CLOSURE FOR DISPENSING CONTAINER

[75] Inventor: Jakob Rech, Detroit, Mich.

[73] Assignees: Sheldon H. Applefield; Jerome Applefield, both of Southfield, Mich.; part interest to each

[21] Appl. No.: 726,418

[22] Filed: Sep. 24, 1976

[51] Int. Cl.[2] ..... B65D 25/48

[52] U.S. Cl. ..... 222/505; 222/507; 222/545; 222/554

[58] Field of Search ..... 222/554, 505, 507, 548, 222/545; 251/229

[56] References Cited

U.S. PATENT DOCUMENTS

| | | | |
|---|---|---|---|
| 1,476,700 | 12/1923 | Feldstein | 222/545 |
| 1,491,911 | 4/1924 | Hussar | 222/507 |
| 1,772,379 | 8/1930 | Witt | 222/554 X |
| 1,871,640 | 8/1932 | Weaver | 222/545 X |
| 2,005,871 | 6/1935 | Remy | 222/507 |
| 2,790,583 | 4/1957 | Kolenda | 222/554 |
| 2,822,111 | 2/1958 | Tripoli | 222/545 X |
| 3,642,172 | 2/1972 | Maldas | 222/554 X |
| 3,690,521 | 9/1972 | Middleton | 222/548 X |

FOREIGN PATENT DOCUMENTS

| | | | |
|---|---|---|---|
| 650863 | 1/1963 | Italy | 222/554 |
| 600753 | 4/1948 | United Kingdom | 222/554 |

*Primary Examiner*—Stanley H. Tollberg
*Assistant Examiner*—Frederick R. Handren
*Attorney, Agent, or Firm*—Hauke and Patalidis

[57] ABSTRACT

A valved closure for a container holding plastic or pasty material and having an opening generally in the form of a neck for dispensing the material from the container. The valved closure is permanently or, in the alternative, removably mounted over the neck of the container. The valved closure consists of a hollow housing with an aperture for placing the interior of the container in communication with the ambient and, a rotatable valve body being disposed proximate the aperture such as to obturate the aperture in a first position. The valve body has a passageway placing the interior of the housing in communication with the housing aperture in a second position of the valve body. The valve body is directly actuatable by means of a lever or, in the alternative, by means of a slide or a rotatable collar. The housing dispensing aperture has at least one chamfered side forming a sharp cutting edge for a ribbon of pasty material being dispensed from the container and for defining a non-recessed surface permitting to keep clean the edges of the aperture. Although the valved closure of the invention is particularly well-suited for plastic or pasty material being dispensed, its use is not so limited and it is as effective as a means for dispensing liquid or powder materials.

11 Claims, 12 Drawing Figures

FIG. 2
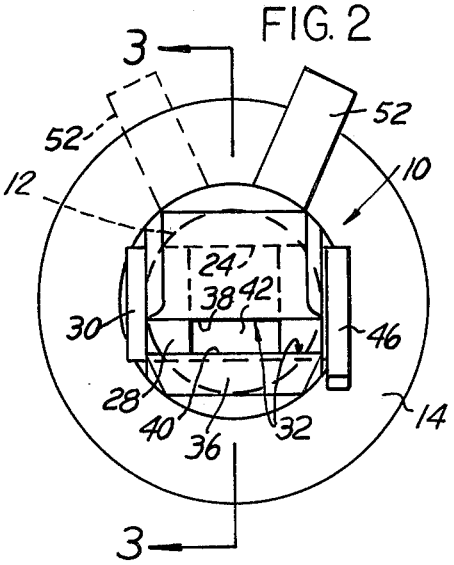
FIG. 1
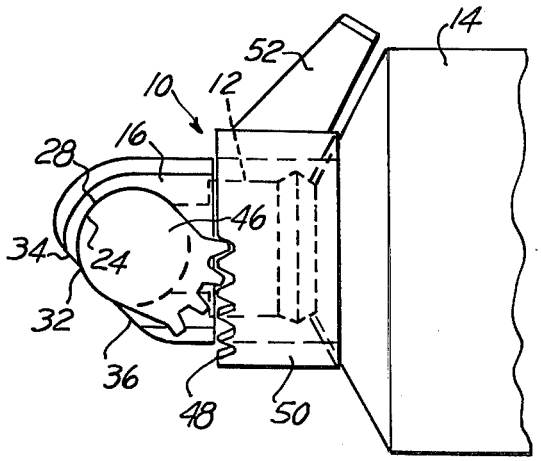
FIG. 1A
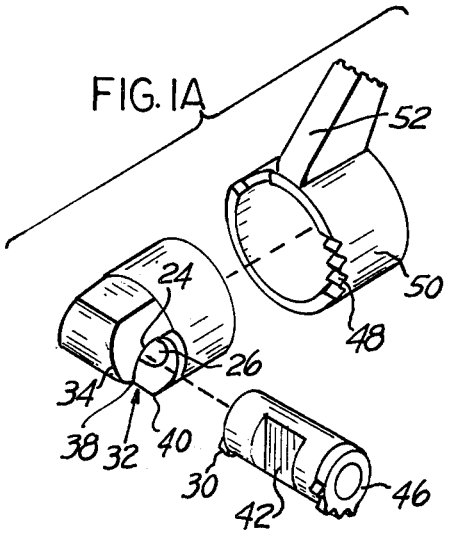
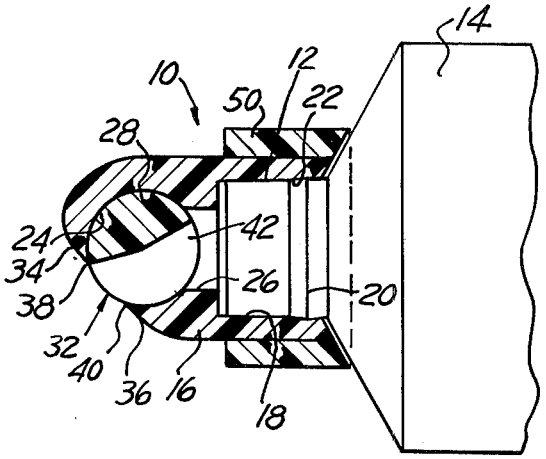
FIG. 3
FIG. 4
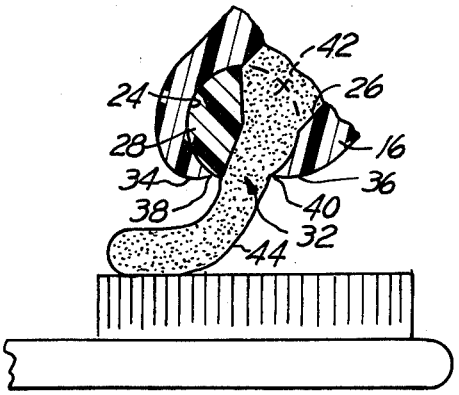
FIG. 5
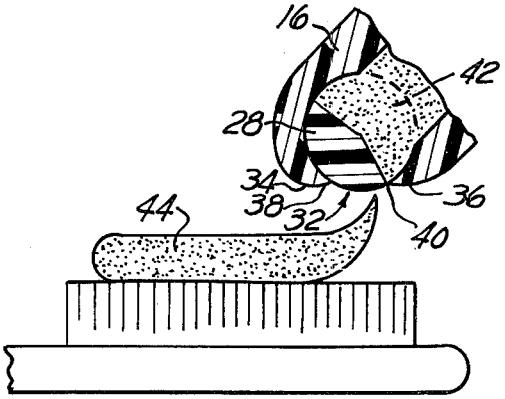

FIG. 7
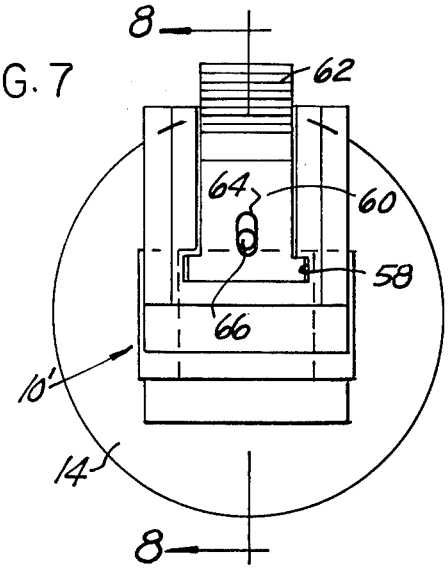
FIG. 6
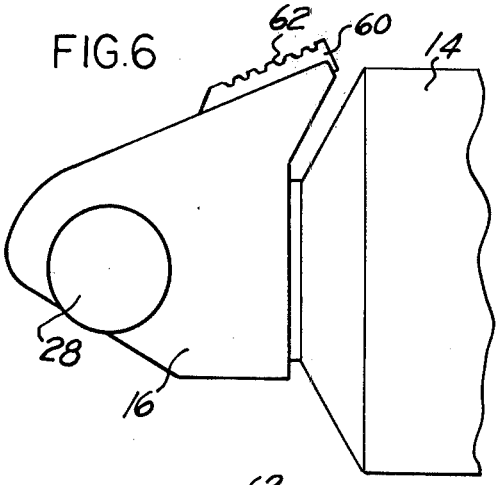
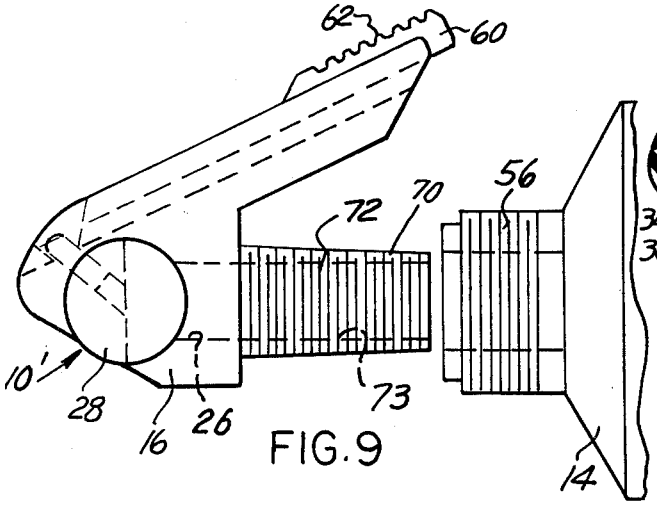
FIG. 9
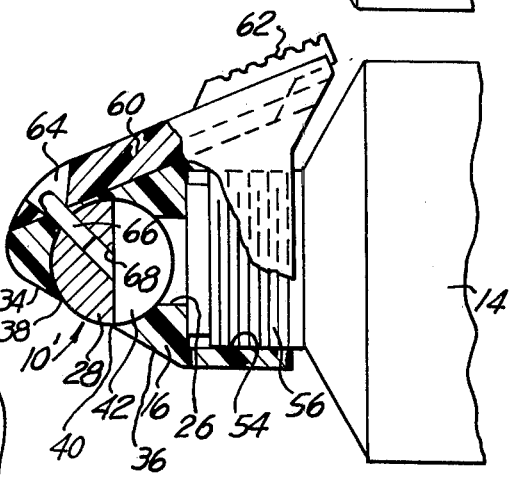
FIG. 8
FIG. 10
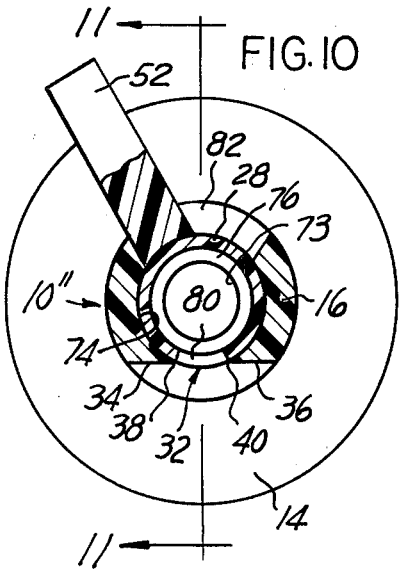
FIG. 11
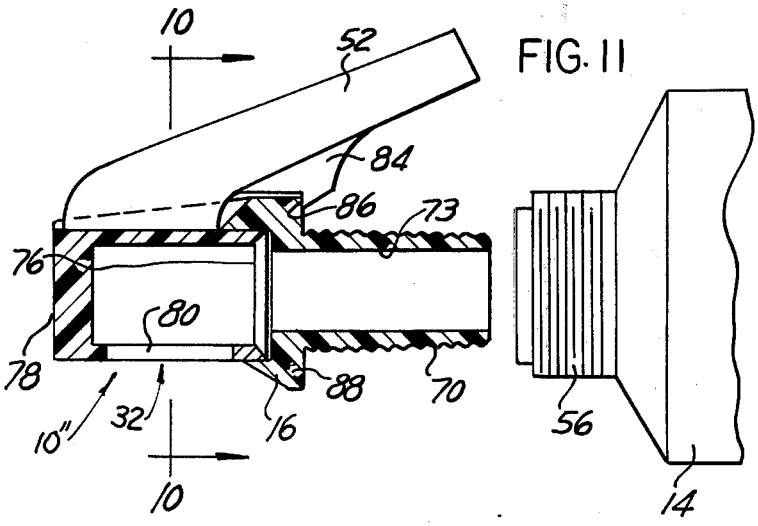

VALVED CLOSURE FOR DISPENSING CONTAINER

BACKGROUND OF THE INVENTION

The present invention relates to valved closures for containers used in packaging liquids, powders and more particularly pastes and like substances. Although the invention is useful as a closure and dispensing means for glass, plastic or metallic containers, it is particularly well-adapted to collapsible tubes of the kind used for packaging paste products such as toothpaste, hand and body lotions, shaving cream, paint pigments, paste food, cement and glue, and like material.

Such collapsible tubes, generally made of a soft metal and sometimes of thin pliable plastic, are designed to permit the contents to be ejected in desired quantities upon manual pressure being exerted on the wall of the tube. They are provided with a neck through which the contents is ejected, and the neck is generally peripherally threaded for cooperation with a threaded closure cap. When it is desired to remove a portion of the contents from the tube, the cap is removed, a desired portion of the contents is expelled and the remainder of the contents in the tube is sealed from the ambiant by returning the cap to the threaded neck portion.

Although collapsible tubes with removable caps present many inconveniences, they have been generally accepted for many years as packaging and dispensing means for diverse products. A first inconvenience is that the threaded cap is often difficult to remove from the threaded neck portion, especially when the collapsible tube contains a material tending to dry and harden when exposed to the atmosphere. In view of the relative elasticity of the collapsible tube wall, it is often difficult to dispense a measured amount of the material contained in the tube, and the surplus amount of material must be wiped out from the neck aperture and from the neck thread, if it is desired to avoid excessive smearing and possibly the cap remaining stuck on the neck as a result of the material smearing the thread becoming dry and hardened. In addition, the material oozing from the neck to around the bottom of the cap presents a somewhat messy appearance and may result in unsanitary conditions. The cap may be easily dropped and lost, the replacement caps are not easily obtainable. When the collapsible tube is stored without the cap in position over the neck, the contents may ooze out from the tube or, if the contents of the tube consist of an air-hardenable material the contents of the tube in or near the neck portion becomes dry and hard to the point that it may become impossible to squeeze further material from the tube.

Dispensing spouts for containers have been proposed in the past to remedy the inconveniences of removable cap closures for containers. Examples of such structures may consist for example, of an orientable spout, as disclosed in U.S. Pat. No. 2,866,580 which, in one position, places the interior of the container in communication with the ambient by registering with an appropriate dispensing aperture, and which, in a second position out of alignment with the aperture, isolates the interior from the ambient. Particularly when dispensing pasty material such an arrangement allows some of the material to remain in the spout and to dry out, although it is apparently perfectly suitable for dispensing liquids, especially liquids that are prone to evaporation such as lighter fluid and the like.

Other devices have been designed having a rotatable ball valve disposed in the neck of the container, as disclosed in U.S. Pat. Nos. 1,960,393 and 2,790,583, for example, the ball being provided with a passageway placing the interior of the container in communication with the ambiant in one position and isolating the interior from the ambiant in a second position wherein the passageway is engaged with a wall of the recess holding the ball. As the ball is elastically retained in a partially spherical socket, the use of too much pressure applied to the collapsible tube may expell the ball from its seat. If excessive pressure is externally applied on the ball, or if the container is dropped and the ball hits the ground, the ball may be pushed into the tube with the accompanying result that the closure becomes inoperable.

Other arrangements for dispensing closures which have been proposed, as disclosed in U.S. Pat. Nos. 1,598,434 and 2,534,139, for example, consist of an apertured rotatable outer sleeve surrounding an apertured inner sleeve. When the outer sleeve is rotated to a position matching the apertures, material may be dispensed from the container. The container is closed by rotating the outer sleeve to a position removing the apertures from registry. Such an arrangement presents the inconvenience that it generally necessitates the use of both hands for operation. The outer sleeve is provided with an enlarged diameter knurled portion which interferes with neat dispensing of the material, and some amount of the material remains in the outer sleeve aperture which results in unsanitary conditions and, after the material becomes dry and hard, operation of the closure becomes difficult.

SUMMARY OF THE PRESENT INVENTION

The inconveniences of the prior art relating to dispensing closures for containers are remedied by the present invention providing a valved closure taking the form of a housing attached to the container, and having a dispensing aperture for placing the interior of the container in communication with the ambient. A rotatable valve body is disposed proximate the dispensing aperture, and is movable from a position obturating the dispensing aperture to a position placing a passageway disposed through the valve body in registry with the dispensing aperture so as to permit material to be dispensed from the container. The valve body is directly actuated by a lever affixed to the valve body itself, or by means of a tooth sector affixed to the valve body meshing with a rotatable collar provided with a toothed edge or, alternatively, by means of a slide engaging a pin projecting from the valve body. The sides of the housing dispensing aperture are chamfered for the double purpose of forming a sharp cutting edge for a ribbon of pasty material being dispensed from the container and of providing a non-recessed dispensing aperture in the housing which may be kept clean and sanitary.

BRIEF DESCRIPTION OF THE DRAWING

A better understanding of the present invention will be had by those skilled in the art when the following description of the best modes contemplated for practicing the invention is read in conjunction with the accompanying drawing wherein like reference numerals refer to like or equivalent parts and in which:

FIG. 1 is an elevation view of a valved closure for a container, according to the present invention;

FIG. 1A is an exploded view thereof;

FIG. 2 is a front elevation view thereof;

FIG. 3 is a sectional view along line 3—3 of FIG. 2;

FIGS. 4 and 5 are simplified schematic views useful in explaining the principle of the present invention;

FIG. 6 is a side elevation view of a modification of the invention;

FIG. 7 is a front elevation view thereof;

FIG. 8 is a partial sectional view along line 8—8 of FIG. 7;

FIG. 9 is a modification of the structure of FIGS. 6–8; and

FIGS. 10 and 11 are respectively a transverse sectional view and a longitudinal sectional view of a further modification of the present invention.

DETAILED DESCRIPTION OF THE PREFERRED EMBODIMENTS

Referring now to the drawing and more particularly to FIGS. 1–3, there is illustrated a valved closure cap 10 according to the present invention fastened to the neck 12 of, for example, a collapsible tube 14. The valved closure 10 comprises a hollow housing 16, generally cylindrical and provided with an open end 18 adaptable for mounting over the neck 12 of the collapsible tube 14. In the example illustrated, and as best shown at FIG. 3, the open end 18 of the housing 16 is press-fitted over the neck 12, the peripheral surface of the tube neck 12 being provided with an annular projecting ridge 20 engageable in a conforming shallow groove 22 either preformed on the inside surface of the end 18 of the housing 16, or alternatively when the housing 16 is made of a relatively soft or resilient plastic or of a soft deformable metal, which is caused by the deformation of the inner surface of the housing end 18. Other means than those illustrated may be used for fastening the housing 16 over the neck 12, such as serrations and the like. In the example illustrated at FIGS. 1–3, the housing 16 is permanently attached to the tube neck 12 in the stead of the conventional screw-on cap.

A cylindrical recess 24 is formed in the projecting end of the housing 16, such cylindrical recess extending from one side of the housing 16 to the other with its axis disposed substantially at right angle to the axis of a longitudinal bore 26 formed in the housing. A circularly cylindrical valve body 28 is rotatably disposed in the cylindrical recess 24, being held therein by way of any convenient means such as, for example, a slightly enlarged diameter portion 30 (FIG. 2), a radial projection, a diametrically disposed pin or the like. The nose of the housing 16 is provided with a slotted dispensing aperture 32 extending from side to side of the housing, and through which slightly projects a portion of the peripheral surface of the cylindrical valve 28. The slotted aperture 32 is chamfered and has two substnatially parallel longitudinal sides 34 and 36 preferably disposed in a common plane and which define a pair of parallel sharp edges 38 and 40 for the slotted aperture 32, for a purpose to be hereinafter described. The valve body 28 has a removed section forming a passageway 42 (FIGS. 1A, 2 and 3) placing the slotted aperture 32 in communication with the internal bore 26 in the housing 16. In a first position of the valve body 28, as illustrated at FIGS. 2, 3 and 4, the contents of the tube 14 may be forcibly expelled, by collapsing the tube, through the internal bore 26 of the housing 16, and through the passageway 42 and the slotted aperture 32. When the contents of the tube 14 consist of a pasty material such as toothpaste for example, a ribbon 44 of the material is thus expelled from the tube, FIG. 4, onto the bristles of a toothbrush. In order to terminate the dispensing of the material, the valve body 28 is rotated to the position shown schematically at FIG. 5 which removes the passageway 42 through the valve body from registering with the slotted aperture 32, thus hermetically closing the tube. The sharp edge 40 of the slotted aperture 32 acts as a shearing means for cutting off the ribbon 44 of pasty material with the result that a clean, sharp break of the exact desired amount of dispensed material is obtained, and smearing of the flat surfaces 34 and 36 forming the lips of the slotted aperture 32 is unlikely. Whatever light smearing may nevertheless result can easily be removed by wiping, such that the edges of the chamfered slotted aperture 32 are always neat in appearance and are sanitary.

The valve body 28, in the example of embodiment illustrated at FIGS. 1–3, is rotated by means of a toothed sector 46 having teeth meshing with the teeth formed at an edge 48 of a ring or collar 50 rotatably mounted about the housing 16. The rotatable collar 50 may be manually rotated or, preferably, it is provided with a lever 52 projecting on the side of the collar so as to permit to open and close the slotted aperture 32 by operation of the lever 52 by one finger of the same hand used for pressing on the collapsible tube 14. The lever 52 is movable from the solid line position shown at FIG. 2 to the phantom line position and appropriate abutment means, not shown, are provided for limiting the swinging of the lever 52 and therefore the amount of rotation of the collar 50. It can be seen that rotation of the collar 50 causes in turn a rotation of the valve body 28 as a result of the teeth on the edge 48 of the collar 50 engaging the teeth of the toothed sector 46.

The toothed sector 46 may be molded integrally with the valve body 28, or it may be cemented or otherwise fastened on an end thereof. The valve body 28 with its toothed sector 46 affixed thereto can easily be mounted in the partially cylindrical recess 24 in the nose of the housing 16 by pressing the valve body into the recess. As the material forming the housing 16, preferably a plastic, is resilient, the enlarged diameter portion 30 on the other end of the valve body 28 spreads apart the edges 38 and 40 of the slotted aperture 32, thus slightly increasing the diameter of the cylindrical recess 24 and permitting the enlarged diameter portion 30 of the valve body to be pushed through from one end of the cylindrical recess 24 to the other, after which the sides of the cylindrical recess spring back to their original position, thus circularly holding the valve body 28 in position about its longitudinal axis but still permitting rotation of the valve body 28 within the partially cylindrical recess 24. Alternatively, the end of the valve body 28 may be provided with a radially projecting prong which is aligned with the slotted aperture 32 while the valve body 28 is pressed into the recess 24.

The valved closure 10' illustrated at FIGS. 6–8 differs from the embodiment of FIGS. 1–3 in only two respects. The housing 16 of the valved closure 10' has an internally threaded open end 54 for fitting over the threaded neck 56 of the tube 14. The valved closure 10' of FIGS. 6–8 may therefore be used as a replacement for collapsible tube conventional caps, by removing the cap and screwing the valved closure 10' on the threaded neck 56 of the tube. The valved closure 10' of FIGS. 6–8 also differs from the embodiment of FIGS. 1–3 with respect to the means for rotating the valve body 28. In the embodiment of FIGS. 6–8, the housing 16 is provided with a keyway 58 accepting a T-slotted slide 60.

The rear end of the slide 60 proximate the tube 14 is provided with a knurled or ribbon surface 62 for ease of single hand manipulation. The forward end of the slide 60 has an aperture 64 into which projects a pin 66 press-fitted in a substantially radial bore 68 disposed in the valve body 28. It can thus be seen that longitudinal motion of the slide 60 results in rotation of the valve body 28 from the closed position illustrated at FIG. 8, to a position placing the passageway 42 in the valve body 28 in registry with the slotted dispensing aperture 32 in the housing 16. The valve body 28 is held against longitudinal displacement by the pin 66 projecting into the aperture 64 in the slide 60.

The embodiment of FIG. 9 is identical to the embodiment of FIGS. 6–8, except that the means for attaching the valved closure 10' of FIG. 9 to the neck 56 of the tube 14 consists of a tapered tubular coupling 70 provided with serrations on its peripheral surface or preferably threads as shown at 72 and having a longitudinal bore 73 aligned with the housing bore 26. Because of its tapered structure the coupling 70 is capable of accomodating a range of internal diameters of tube necks, such that the valved dispenser of the invention, when provided with the coupling means of the threaded tapered coupling 70, can be used in combination with a variety of collapsible tubes or containers of different sizes having necks of different sizes within a range. It will be readily apparent that the valved dispenser 10 of the embodiment of FIGS. 1–3 may be also provided with such a universal type coupling or fitting 70, or in the alternative, with an internally threaded open end for affixing to the peripheral surface of an externally threaded neck, as described with respect to the embodiment of FIGS. 6–8.

FIGS. 10–11 illustrate a further embodiment of the present invention. The valved dispenser 10" consists of a substantially cylindrical housing 16 having a cylindrical internal bore 74 having a longitudinal axis substantially aligned with the longitudinal bore 73 of the tapered fitting 70 shown as made integral with the housing 16. The slotted dispensing aperture 32 is disposed on one side of the cylindrical housing 16 and as in the previously described embodiments, has flat side surfaces 34 and 36 defining sharp edges 38 and 40. A tubular valve body 28 is rotatably disposed within the cylindrical bore 74. The tubular cylindrical valve body 28 has an open end 76 aligned with the internal bore 73 of the fitting 70 and a closed forward end 78. A substantially rectangular aperture 80 is formed in the wall of the tubular valve body 28. A lever 52 is made integral or affixed to the valve body 28 and projects through a slot 82 in the wall of the housing 16. The slot 82 is wider than the thickness of the lever 52, such that by action through the lever 52 the valve body 28 may be rotated from a position wherein the aperture 80 through the wall of the tubular valve body 28 registers with the slotted aperture 32 in the wall of the housing 16, whereby the contents of the tube 14 may be expelled, as illustrated at FIG. 10 to a position out of registry thus closing the tube.

Any convenient means may be used for holding the valve body 28 in the internal bore in the housing 16, such as grooves ridges, pins, or the arrangement shown at FIG. 11 consisting of a projecting tongue 84 formed integral with the lever 52 and having an abutment 86 interfering with an enlarged diameter annular portion 88 of the housing 16 disposed about the open end of the housing. When the valve cylindrical body 28 is pushed into the cylindrical bore 74 during assembly, due to the resiliency of the material used for making the housing 16 of the abutment 86 of the tongue 84 is caused to snap below the enlarged diameter annular portion 88, thus preventing accidental removal of the valve body from the housing cylindrical bore.

Although the embodiment of FIGS. 10–11 has been described as consisting of a stationary housing 16 and a rotatable valve body 28, it will be readily apparent that the valve body 28 may be made stationary and affixed to the coupling 70 and the housing 16 disposed rotatable over the stationary valve body 28, in which case the lever 52 is attached directly to, or molded integral with the housing 16.

It is readily apparent that the valved closure 10" of FIGS. 9–10 may be provided with any one of the press-fit or threaded means for attaching to the neck of the container as previously explained.

Having thus described the present invention by way of examples of structural embodiments, modifications whereof will be apparent to those skilled in the art, what is claimed as new is as follows:

1. A closure for a dispensing container comprising a housing, means for attaching said housing to said container and for placing the interior of said housing in communication with the interior of said container, a slotted dispensing aperture formed in a wall of said housing and extending from side to side of said housing, a cylindrical valve body disposed rotatably in said housing proximate said dispensing aperture and having a peripheral surface normally obturating said dispensing aperture when said valve body and said housing are mutually rotated to a first position, said valve body having a passageway therethrough for placing the interior of said housing in communication with said dispensing aperture when said valve body and said housing are mutually rotated to a second position, said dispensing aperture having a pair of opposite side edges chamfered and each lying in a plane substantially coplanar with the plane of the other chamfered side edge, each of said chamfered side edges forming a sharp edge whereby a ribbon of pasty material dispensed from said container is sheared off upon rotation of said valve body from said second to said first position and cleaning of the edges of said aperture is greatly facilitated, and means for rotating said valve body, wherein said means for rotating said valve body comprises a toothed sector affixed to an end of said valve body and a collar rotatably disposed about said housing, said collar having a toothed edge meshing with said toothed sector.

2. The closure of claim 1 further comprising a lever attached to said collar.

3. The closure of claim 1 wherein said dispensing container has a neck with a peripheral thread and said housing has an open end provided with an internal thread for engagement with said peripheral thread.

4. The closure of claim 1 wherein said dispensing container has a neck and said housing has an open end press-fitted over said neck.

5. The closure of claim 1 wherein said dispensing container has a neck made of substantially soft material and said housing has an open end provided with a tapered tubular projection having a peripheral thread for engagement within said neck.

6. The closure of claim 1 wherein the passageway in said cylindrical valve body comprises a cut-out portion removed from said body.

7. A closure for a dispensing container comprising a housing, means for attaching said housing to said container and for placing the interior of said housing in communication with the interior of said container, a slotted dispensing aperture formed in a wall of said housing and extending from side to side of said housing, a cylindrical valve body disposed rotatably in said housing proximate said dispensing aperture and having a peripheral surface normally obturating said dispensing aperture when said valve body and said housing are mutually rotated to a first position, said valve body having a passageway therethrough for placing the interior of said housing in communication with said dispensing aperture when said valve body and said housing are mutually rotated to a second position, said dispensing aperture having a pair of opposite side edges chamfered and each lying in a plane substantially coplanar with the plane of the other chamfered side edge, each of said chamfered side edges forming a sharp edge whereby a ribbon of pasty material dispensed from said container is sheared off upon rotation of said valve body from said second to said first position and cleaning of the edges of said aperture is greatly facilitated, and lever means for rotating said valve body, wherein said lever means for rotating said valve body comprises a pin radially projecting from said valve body, a slide member disposed on said housing and an aperture in said slide member engaged by the projecting portion of said pin.

8. The closure of claim 7 wherein said dispensing container has a neck with a peripheral thread and said housing has an open end provided with an internal thread for engagement with said peripheral thread.

9. The closure of claim 7 wherein said dispensing container has a neck and said housing has an open end press-fitted over said neck.

10. The closure of claim 7 wherein said dispensing container has a neck made of substantially soft material and said housing has an open end provided with a tapered tubular projection having a peripheral thread for engagement within said neck.

11. The closure of claim 7 wherein the passageway in said cylindrical valve body comprises a cut-out portion removed from said body.

* * * * *